US005667320A

United States Patent [19]

Ambrose et al.

[11] Patent Number: 5,667,320

[45] Date of Patent: Sep. 16, 1997

[54] KEYBOARD, PALM REST, AND, MOUSE TRAY POSITIONING SYSTEM

[76] Inventors: Frederic C. Ambrose, 142 The Channel, Brewster, Mass. 02631; David Hawley, 108 Chase Hill Rd., Sterling, Mass. 01564

[21] Appl. No.: 632,640

[22] Filed: Apr. 15, 1996

Related U.S. Application Data

[63] Continuation of Ser. No. 315,098, Sep. 29, 1994, abandoned.

[51] Int. Cl.[6] ..... B41J 29/00

[52] U.S. Cl. ..... 400/472; 400/715; 248/118.3

[58] Field of Search ..... 400/472, 715, 400/717, 473; 248/118, 118.1, 118.3, 918, 919; 108/139, 143; D14/114, 115

[56] References Cited

U.S. PATENT DOCUMENTS

| | | | |
|---|---|---|---|
| 293,971 | 2/1884 | Lyford | 38/107 |
| 1,189,529 | 7/1916 | Benson | 38/106 |
| 4,307,672 | 12/1981 | Shikimi | 108/139 |
| 4,644,875 | 2/1987 | Watt | 108/143 |
| 4,688,862 | 8/1987 | Fowler et al. | 248/118.3 |
| 4,736,689 | 4/1988 | Stanko | 108/5 |
| 5,016,367 | 5/1991 | Breen et al. | 38/107 |
| 5,205,631 | 4/1993 | Wegman et al. | 312/348.3 |
| 5,273,250 | 12/1993 | Pemberton et al. | 248/918 |
| 5,351,898 | 10/1994 | Martin | 248/918 |
| 5,357,873 | 10/1994 | Hilton | 108/92 |

*Primary Examiner*—Edgar S. Burr
*Assistant Examiner*—Anthony H. Nguyen
*Attorney, Agent, or Firm*—Testa, Hurwitz & Thibeault, LLP

[57] ABSTRACT

Disclosed is a device adapted to mount to a desk and for use with a computer keyboard and/or a mouse. In one embodiment, the device comprises a stationary bracket attached to the desk, a main housing attached to the stationary bracket, a keyboard support tray supportably connected to the main housing and adapted to support the keyboard. The device further comprises a palm rest movably connected to the main housing and a first engagement member being operable in a first position wherein the keyboard support tray and the palm rest are substantially movable and a second position wherein the keyboard support tray and the palm rest are substantially fixed. In a second embodiment of the present invention, the device may further comprise a mouse support tray movably connected to the main housing so that the user of the computer system may adjust the position of the mouse support tray for optimal ergonomic use of the mouse. The mouse support tray may be adjusted by one mechanism in the vertical plane as well as be adjustably tiled relative to the vertical place. With the use of a second mechanism, the mouse support tray may be rotatably adjusted in the horizontal plane.

4 Claims, 10 Drawing Sheets

10
12
14
178
182
24
20
148
152
16
18
150
22
146

4-4

10-10
12
64
66
68
70
72
74
76
78
80
82
83
84
85
86
19

16
92
94
94
92
100

16
88
90
96
102
100
86
98

94
92
16
98
88
86
98
90
96

16-16

KEYBOARD, PALM REST, AND, MOUSE TRAY POSITIONING SYSTEM

This application is a continuation of application Ser. No. 08/315,098 filed Sep. 29, 1994 now abandoned.

FIELD OF THE INVENTION

The present invention relates generally to devices used in the connection with office equipment. More particularly, the present invention relates to a device for use with a computer system having a keyboard and/or a mouse.

BACKGROUND OF THE INVENTION

With the advent of computer systems, people both at home and at the work-place spend numerous hours sitting at the computer system and typing keys on the computer keyboard and/or moving a mouse. Medical professionals, ergonomists and insurance companies agree that significant medical problems result from the prolonged use computer systems in the work-place.

One of the inventors of the present invention is also the inventor of pending U.S. Pat. application Ser. No. 08/094,109 entitled "Keyboard Positioning System" which has been issued a Notice of Allowance. This patent application in its entirety is hereby incorporated by reference into this patent application. The device disclosed and claimed by that patent application solves many of the aforementioned problems resulting from the prolonged use of computer systems. The device of that patent application generally comprises an adjustable keyboard tray and an adjustable palm rest. The device is operable so that a user can independently adjust the position of the keyboard to a desired negative tilt position as well as independently adjust the palm rest to the position most comfortable to the user. The present invention represents furthers improvements to the device disclosed by that patent application.

SUMMARY OF THE PRESENT INVENTION

One object of the present invention is to develop a device for use with computer system having a keyboard which allows the user to easily adjust the position of the keyboard and the palm rest.

Another object of the present invention is to develop a device for use with a computer system having a keyboard and a mouse which allows the user to adjust the position of the mouse independently of either the keyboard and/or the palm rest.

The above objects of the present invention have been realized with the device of the present invention which is adapted to mount to a desk, table or other type of work surface or station and for use with a computer system having a keyboard and/or a mouse. In one embodiment, the device of the present invention generally comprises a stationary bracket that is attached to and disposed below the desk. The device further comprises a main housing which is movably attached to the stationary bracket such that the user may easily slide the main housing from a "stored position" inward of the stationary bracket to a "operable position" outward of the stationary bracket. The device further comprises an adjustable keyboard support tray which is adapted to receive a keyboard. The device further comprises an adjustable palm rest. The device further comprises at least one engagement member operable from an "engaged position" to a "disengage position". When the engagement member is in the disengaged position, both the keyboard and palm rest may be adjusted to the position best suited for the user of the computer system. When the engagement member is in the engaged position, both the keyboard support tray and the palm rest are fixed.

In another embodiment, the present invention may further comprise a mouse support tray adapted for use with a mouse. The mouse support tray may be adjusted independently of both the keyboard support tray and the palm rest. The mouse support tray may be adjusted in both the vertical and tilted position as well being rotatable in the horizontal position. Moreover, the mouse support tray may be moved from a "stored portion" to an "operable position."

With the device of the present invention, a user can easily adjust and lock the position of the keyboard support tray and the palm rest with a single engagement member. As such, the device of the present invention allows the user to quickly set-up for a comfortable work session on the computer system thereby proving more efficient use of time and reducing injuries that result from such use.

BRIEF DESCRIPTION OF THE DRAWINGS

The following detailed description of the present invention will be more fully understood with reference to the accompanying drawings in which.

DETAILED DESCRIPTION OF THE PREFERRED EMBODIMENTS

Figure 1:
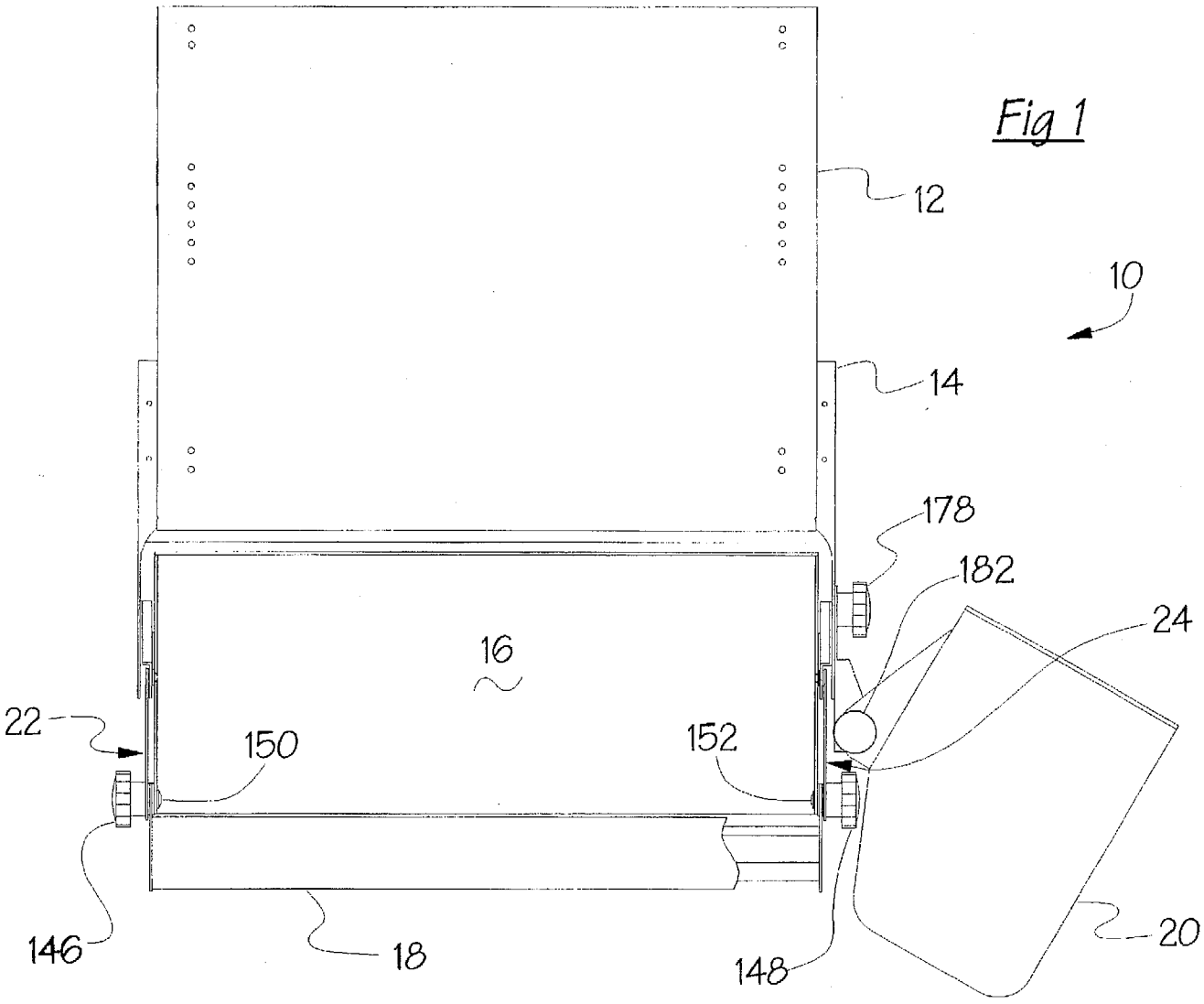
FIG. 1 is a top view of the device of the present invention which shows among things the mouse support tray in an operable position.
Figure 2:
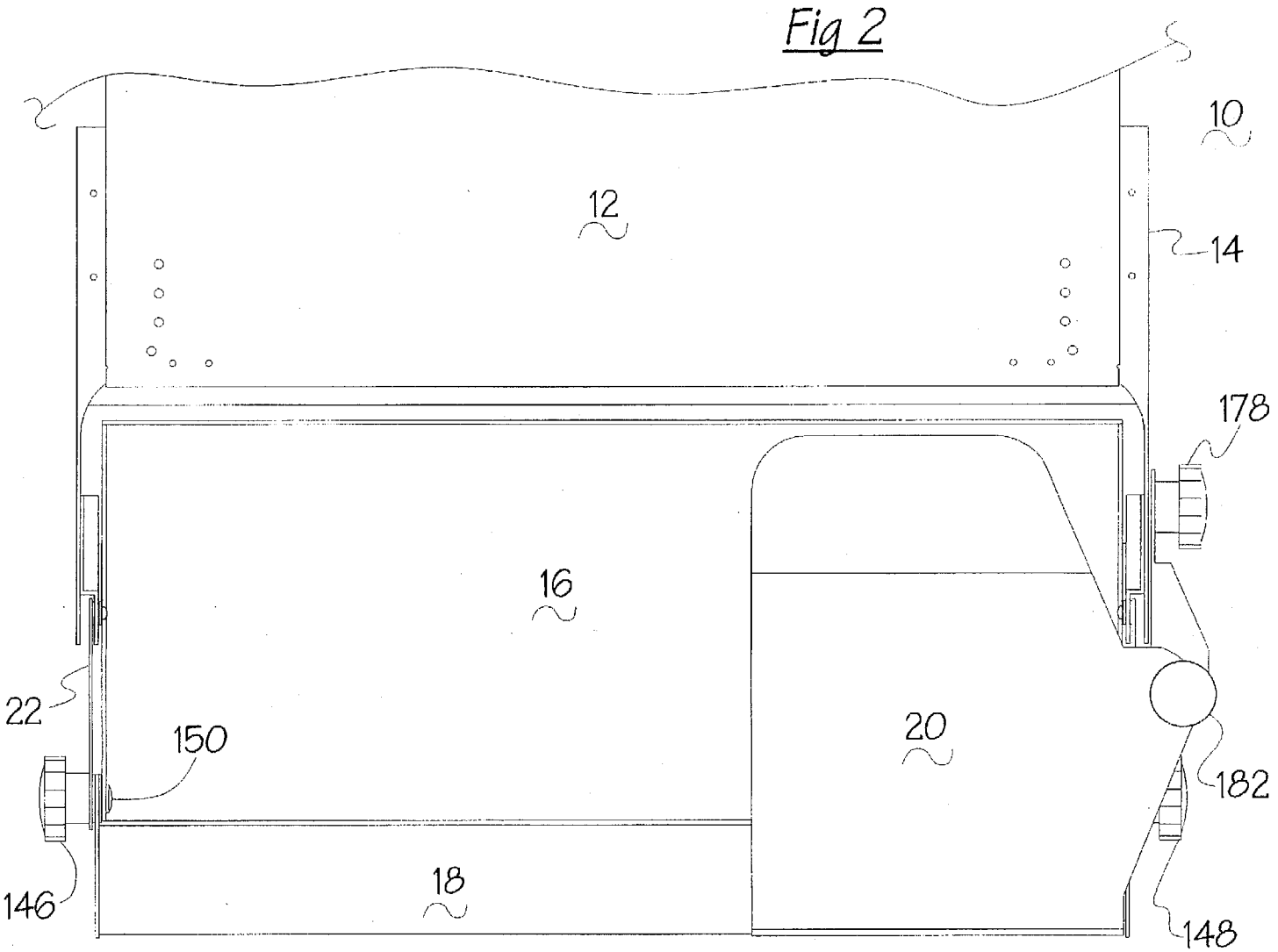
FIG. 2 is a top view of the device of the present invention which shows among things the mouse support tray in a stored position.
Figure 3:
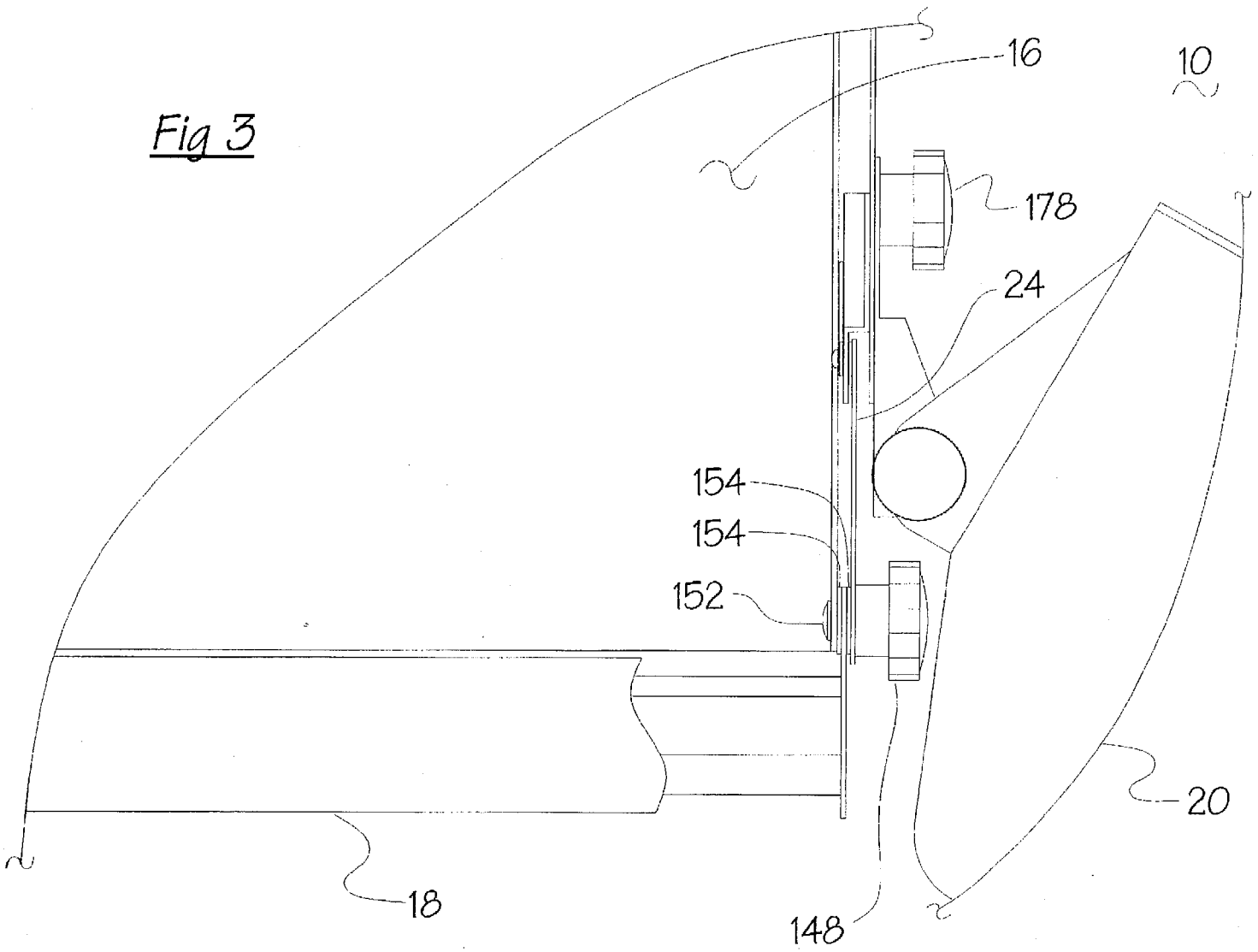
FIG. 3 is a cut-away top view of the device of the present invention.
Figures 4, 5, 6, 7:
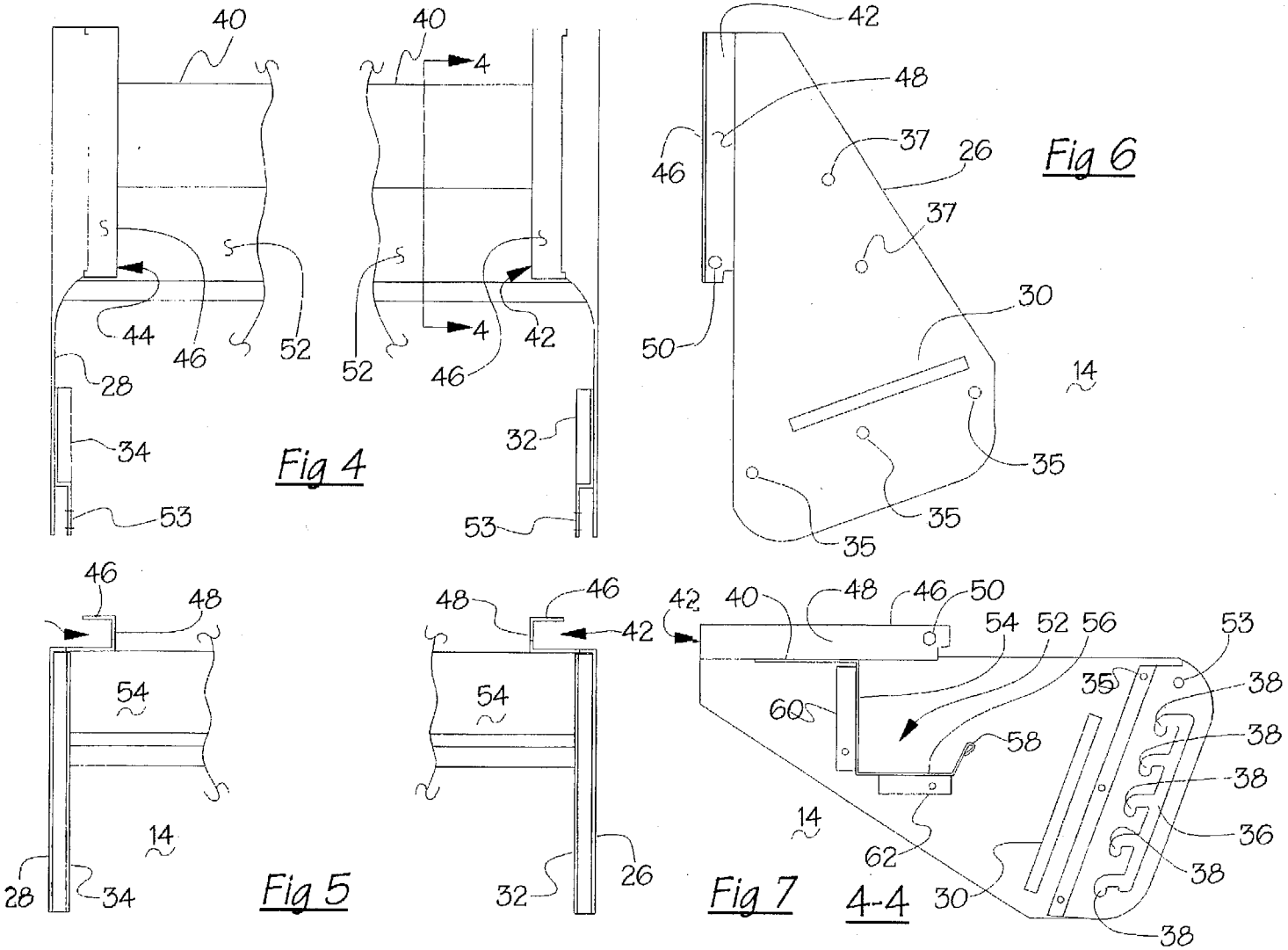
FIG. 4 is a top view of the main housing.
FIG. 5 is a side view of the main housing.
FIG. 6 is a front view of the main housing.
FIG. 7 is a cross-section view of the main housing taken along line 4—4 of FIG. 4.
Figures 8, 9, 10, 11:
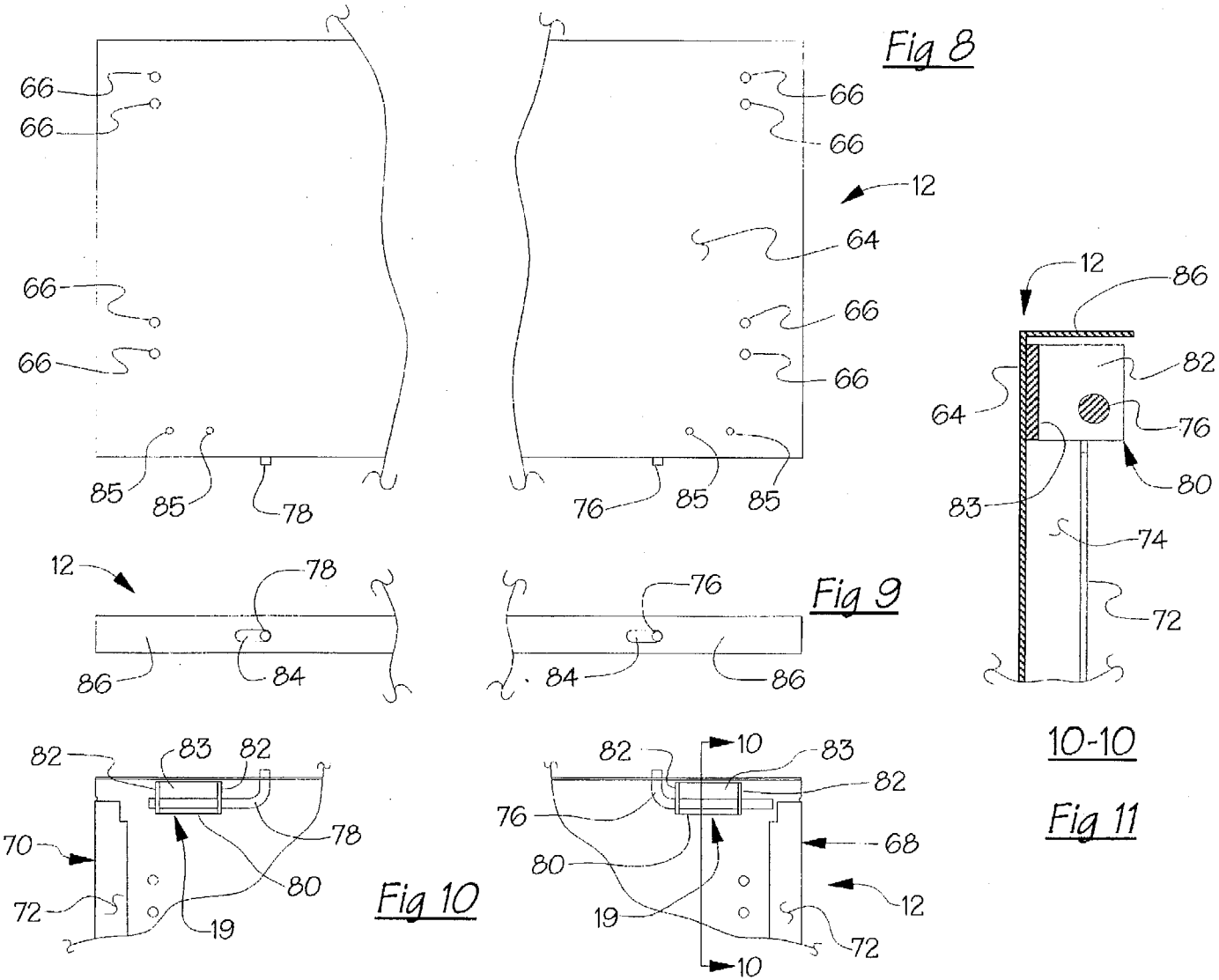
FIG. 8 is a top view of the stationary bracket.
FIG. 9 is a front view of the stationary bracket.
FIG. 10 is a bottom view of the stationary bracket.
FIG. 11 is a cross-section view of the stationary bracket taken along line 10—10 of FIG. 10.

Referring to FIGS. 1–3, wherein one embodiment the device 10 of the present invention generally comprises a stationary bracket 12, a main housing 14, a keyboard support tray 16, a palm rest 18, a mouse support tray 20, and engagement members 22 and 24. The stationary bracket 12 is generally designed to securely attach to and be disposed below a desk top, table or any other work surface (not shown). The main housing 14 is generally provided as a support structure to supportably mount the keyboard support tray 16 and the mouse support tray 20. The main housing 14 and the stationary bracket 12 are mutually designed such that a user may slide the main housing 14 from a "stored position" (not shown) where the main housing 14 is disposed substantially below the stationary bracket 12 and thus the desk (not shown) to an "operable position" as shown in the drawings where the keyboard support tray 16 and mouse support tray 20 may be used to support a keyboard (not shown) and/or a mouse (not shown), respectively. The keyboard support tray 16 is generally adapted to receive a keyboard (not shown) and may be adjusted both in the vertical as well as tilt position. In the preferred embodiment, the keyboard support tray be adjusted from a substantially horizontal position to a negative tilt position of approximately twenty-five (25) degrees. The palm rest 18 is generally adapted to provide a support surface for the user's palm and/or wrist and may be adjusted to any one of a variety of positions best suited for the user of the device 10. Engagement members 22 and 24 are generally provided so that a user may operate a single mechanism to adjust and then lock the position of the keyboard support tray 16 and palm rest 18. The engagement members 22 and 24 are operable from a "disengaged position" to an "engaged position" whereby in the disengaged position, both the keyboard support tray 16 and the palm rest 18 may be adjusted to most comfortable position for the user of the computer system. Conversely, in the engaged position both the keyboard support tray 16 and the palm rest 18 are fixed and ready for use. The mouse support tray 20 is generally designed to receive a mouse (not shown). The mouse support tray 20 is adjustable to any one of a variety of positions most comfortable to the user and independently of the both the keyboard support tray 16 and the palm rest 18. In the preferred embodiment, the mouse support tray 20 may be adjusted in the vertical plane as well as tilted relative to the vertical plane. Moreover, the mouse support tray 20 may be adjustably positioned in the horizontal plane.

Referring to FIGS. 4–7, wherein the main housing 14 is shown generally comprising side walls or panels 26 and 28 each having a slot 30 for use when the mouse support tray 20 is desired. The side walls 26 and 28 have bracket members 32 and 34, respectively, attached to a front portion of the side walls by conventional means such as rivets 35. Each of the bracket members 32 and 34 comprise a slot 36 and a plurality of openings 38 which function to provide a variety of vertical and pivot support positions for the keyboard support tray 16. Each of the bracket members 32 and 34 further comprise an opening 53 which as will be described more fully herein is provided to rotatably mount the engagement members 24 and 22, respectively. Although in the preferred embodiment, the brackets 32 and 34 are attached to the side walls 26 and 28, respectively, the side walls 26 and 28 may be integrally formed with the slot 36 and openings 38. The main housing 14 further comprises a support member 40 having flanges 42 and 44 disposed on the upper and opposite sides thereof. Flanges 42 and 44 are adapted to slidably engage with the stationary bracket 12. Each of the flanges has an upper and horizontally disposed surface or wall 46 perpendicular to a vertically disposed wall or surface 48. Each of the flanges 42 and 44 further comprise an opening 50 disposed within the vertically disposed walls 48. As will be described more fully herein, the openings 50 function with a locking mechanism 19 (to be described) so that when the locking mechanism 19 is engaged, the main housing 14 cannot slid inward and/or outward of the stationary bracket 12. The support member 40 further comprises a utility tray 52 for use in storing pencils or others related work items. The utility tray 52 is formed by a back wall or panel 54, a floor wall or panel 56, and a front wall or panel 58. In the preferred embodiment, the utility tray 52 is formed integrally with the support member 40 and is made from sheet metal and formed by conventional bending processes. In this embodiment, the support member 40 further comprises flanges 60 and 62 which extend from both sides of the utility tray 52 and which function to connect the support member 40 to side walls 26 and 28 by conventional means such as rivets 37.

Referring to FIGS. 8–12, where the stationary bracket 12 is shown generally comprising a mounting wall or panel 64 having a plurality of openings 66 so that the stationary bracket 12 may be mounted by conventional means such as screws to the bottom surface of a desk, table or other work surface. The stationary bracket 12 further comprises flanges 68 and 70 which are designed to slidably receive the flanges 42 and 44 of the main housing 14 so that the same may slide inward and outward of the stationary bracket 12. The flanges 68 and 70 each are formed with a side wall or panel 74 and a bottom wall or panel 72.

The stationary bracket 12 further comprises locking mechanisms 19 and 21 which when engaged prevent the main housing 14 from sliding inward and/or outward from the stationary bracket 12. The locking mechanisms 19 and 21 each comprise a mounting bracket 80 having side walls 82 and a mounting wall or floor 83 which is mounted by conventional means such as rivets 85 to the mounting wall 64. The locking mechanisms 19 and 21 further comprise locking members 76 and 78, respectively, which are slidably disposed within the brackets 80. In the preferred embodiment, the locking members 76 and 78 are L-shaped bolts which are slidably disposed through openings (not shown) provided in the side walls 82. Locking member 76 is shown in the engaged position while locking member 78 is shown in the unengaged position. In the engaged position, each of the locking members 76 and 78 would engage with the openings 50 provided in the brackets 26 and 28 of the main housing 14 to prevent the main housing 14 from sliding inward and/or outward of the stationary bracket 12. In the unengaged position, each of the locking members 76 and 78 are clear of the openings 50 and as such the user may slide the main housing 14 inward and/or outward of the stationary bracket 12. The locking members 76 and 78 protrude through slots 84 provided in a front panel 86 of the stationary bracket 12 so that they may be easily accessible by the user of the device 10. slots 84 are designed so that the locking members 76 and 78 may slide from the engaged position to the disengaged position.

Figures 12, 13, 14:
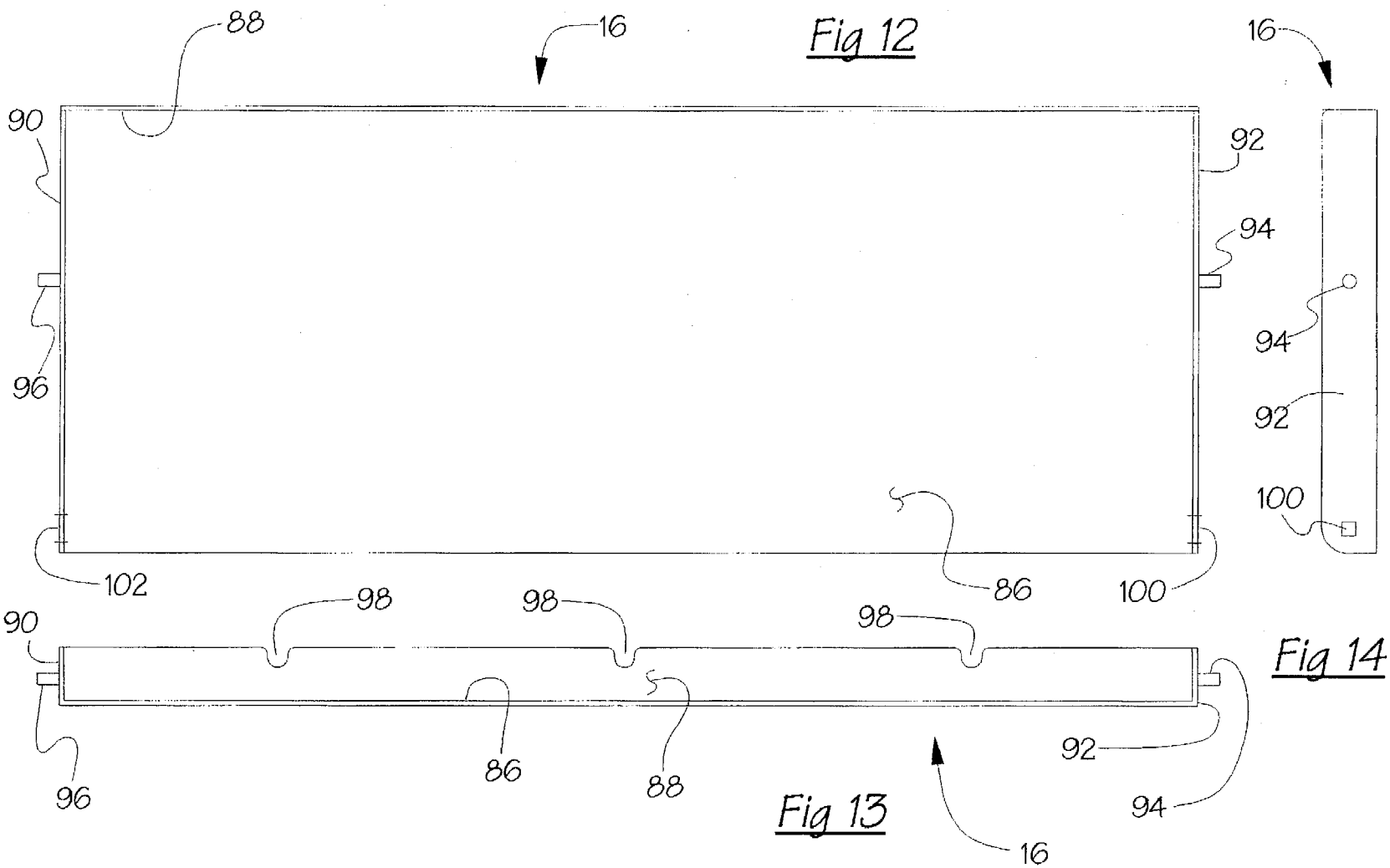
FIG. 12 is a top view of the keyboard support tray.
FIG. 13 is a front view of the keyboard support tray.
FIG. 14 is a side view of the keyboard support tray.

Referring to FIGS. 12–14, where the keyboard support tray 16 is shown generally comprising a support surface 86, a rear side wall or panel 88, and side walls or panels 90 and 92. The keyboard support tray 16 further comprises protrusions 94 and 96 which are adapted to be moveable within slot 36 of bracket 32 and 34, respectively, of the main housing 14 and to further engage within one of the openings 38 of brackets 32 and 34 to thereby establish a vertical position or elevation of the keyboard support tray 16. The protrusions 94 and 96 when engaged within one of the openings 38 act as a pivot point about which the keyboard support tray 16 may be rotatably adjusted to a variety of tilted positions. The keyboard support tray 16 further comprises a plurality of cut-outs or openings 98 disposed in rear wall 88 so that the cord of a keyboard may pass therethrough. The keyboard support tray 16 further comprises openings 100 and 102 which are provided to engage with the engagement members 22 and 24. As will be described more fully herein, when the engagement members 22 and 24 are disengaged, the protrusions 94 and 96 of the keyboard support tray 16 may be moved within slots 36 of brackets 32 and 34 of the main housing 14 and engage within one of the openings 38 of the brackets 32 and 34. Once the engagement members 22 and 24 have been engaged, the protrusions 94 and 96 are locked within the selected vertical defined by openings 38 and as such, the position of the keyboard support tray 16 relative to the main housing 14 is fixed. The keyboard support tray 16 is preferably made from sheet metal and formed by conventional bending processes.

Figure 16:
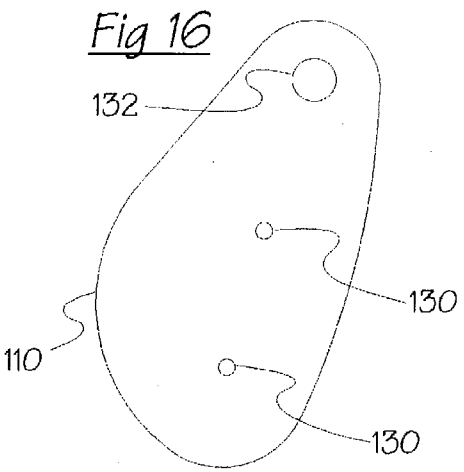
FIG. 16 is a side view of the palm rest.
Figure 17:
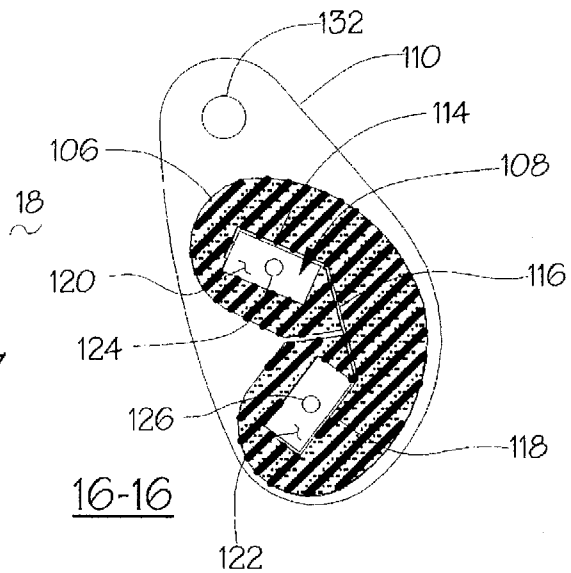
FIG. 17 is a cross-section view of the palm rest taken along line 16—16 of FIG. 16.
Figure 15:
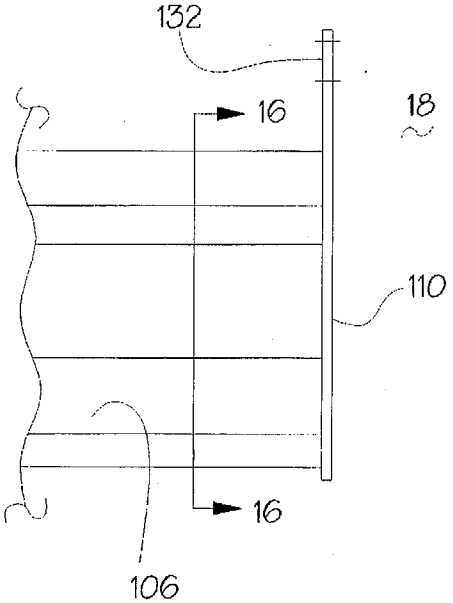
FIG. 15 is a top view of the palm rest.
Figure 15:
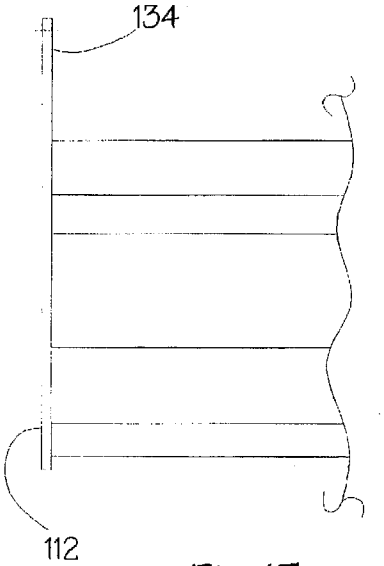

Referring to FIGS. 15–17, where the palm rest 18 is shown generally comprising a pliable material 106 disposed about a support arm 108. The palm rest 18 further comprises side arms 110 and 112 which attached to each end of the support arm 108, respectively. In the preferred embodiment, the support arm 108 is generally formed a single piece of sheet metal and is formed to have walls 114, 116, 118, 134 and 136. The pliable material 106 is preferably disposed around the outside of the walls 114, 116, 118, 134 and 136 and attached by an adhesive material to the inner portion of the wall 116. In the preferred embodiment, the pliable material 106 is made from a foam material. Alternatively, the pliable material 106 may be made from any other soft and comfortable material to act as a cushion for the user's palm and wrist. The support arm 108 further comprise flanges 120 and 122 having openings 124 and 126 disposed on both sides of the support arm 108 which act as a mounting surface for attachment to the side arms 110 and 112 by conventional means such as rivets 130. The side arms 110 and 112 further comprise openings 132 and 134, respectively, which allow the palm rest 18 to be adjustably attached to the engagement members 22 and 24. As will be described more fully herein, when the engagement members 22 and 24 are disengaged, the palm rest 18 may be rotatably adjusted to any one of a variety of positions. Once the engagement members 22 and 24 have been engaged, the position of palm rest 18 relative to the keyboard support tray 16 and/or the main housing 14 is fixed.

Figure 18:
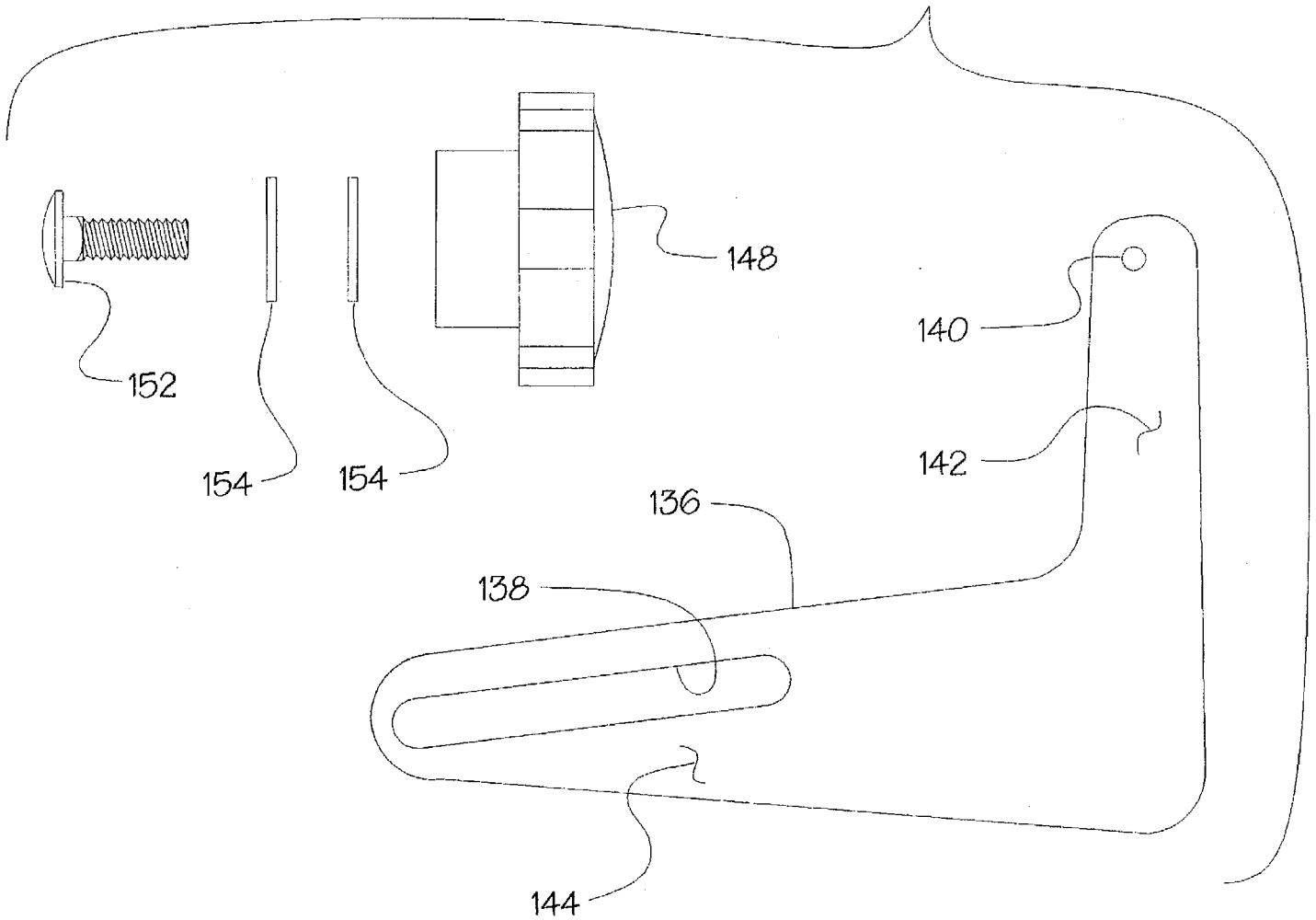
FIG. 18 is an exploded view of the engagement member.

Referring to FIG. 18, an exploded view of the engagement member 24 is shown. The structure and operation of the engagement member 22 is similar to that of engagement member 24 and as such a description of the structure and operation of the engagement member 22 will not be provided herein. The engagement member 24 generally comprising a bracket member 136, a bolt 152 and a knob 148. The bracket member comprises a vertically extending portion 142 having a slot 138 and a horizontally extending portion 144. Disposed within the vertically extending portion 142 is an opening 140 which may be aligned with opening 53 of side bracket 32 of the main housing 14 and connected by conventional means such as a bolt whereby the bracket member 136 is rotatably connected to the main housing 14. As best shown by FIGS. 1–3, bolt 152 is adapted pass through the side wall 92 of the keyboard support tray 16 via opening 100, the bracket member 136 via slot 138, and the palm rest 18 via opening 13. When the knobs 14 is fully tightened or engaged upon the bolt 152, the engagement members 22 is in the "engaged position" and functions to prevent the keyboard support 16 and palm rest 18 from being moved. When the knob 148 is loosened from the bolt 152, the disengaged member 24 is in the "disengaged position" whereby the keyboard support tray 16 and palm rest 178 may be adjusted to the desired position. The engagement member 24 may further comprise one or more washers 154 interposed between the bracket member 136 and/or the palm rest 18 which may serve to more securely fix the position of the keyboard support tray 16 and the palm rest 18 when the engagement member 24 is placed in the engaged position.

Figure 21:
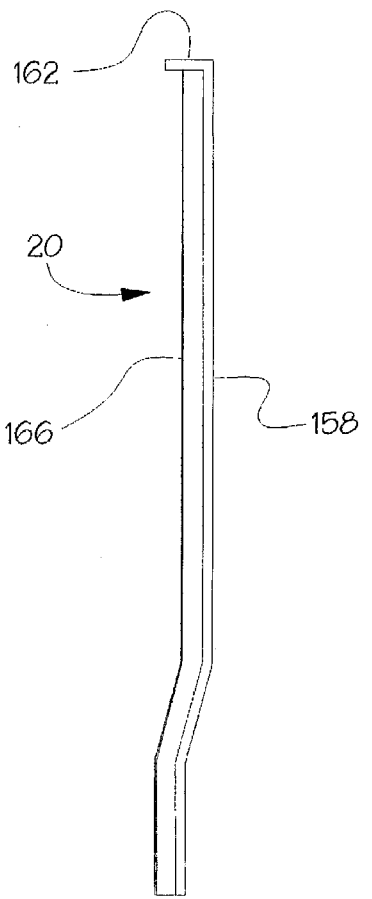
FIG. 21 is a side view of the mouse support tray.
Figure 19:
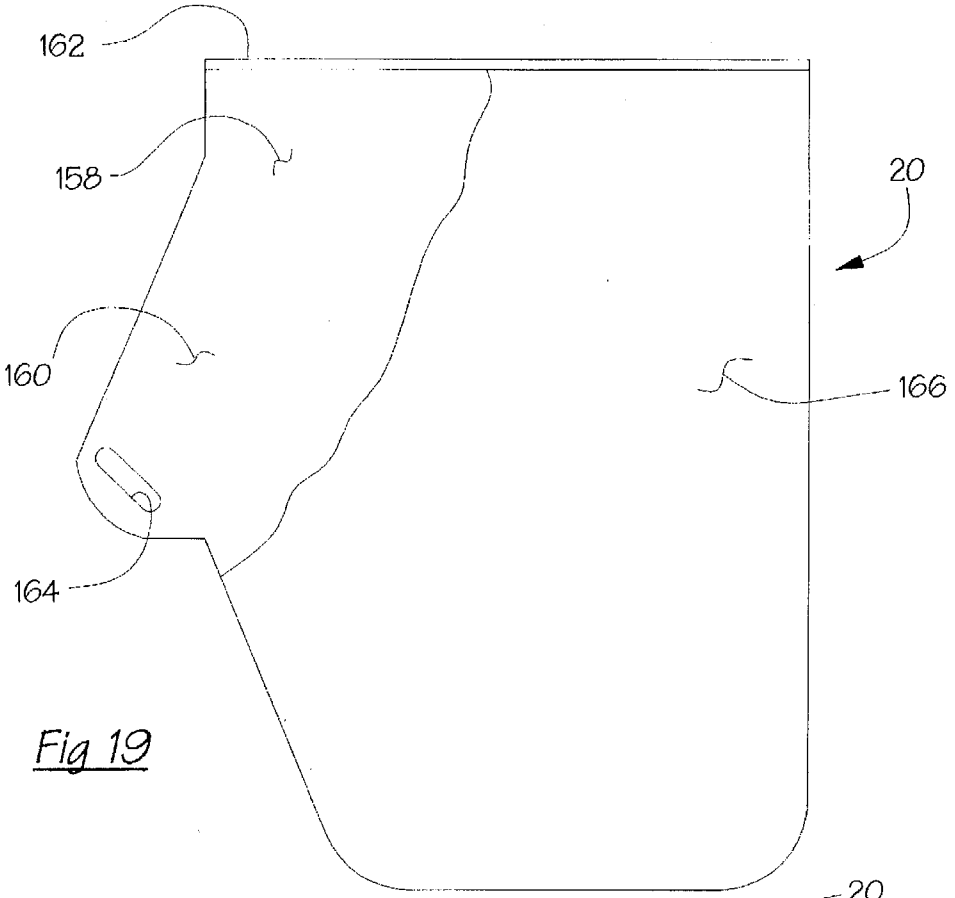
FIG. 19 is a top view of the mouse support tray.
Figure 20:
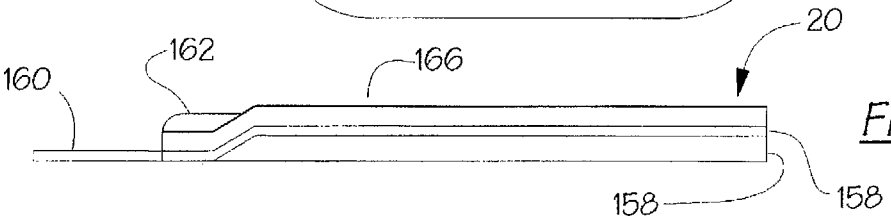
FIG. 20 is front view of the mouse support tray.

Referring to FIGS. 19–21, wherein the mouse support tray support 20 generally comprises a support member 158 having a mounting portion 160 and a rear wall 162. Disposed over the support member 158 is a cushioned and/or pliable material 166 suitable for use with a computer mouse. The mounting portion 160 has a slot 164 which as will be described hereinafter, provides a means of adjustably mounting the mouse support tray 20 to the main housing 14 and/or to a bracket 170 (to be described).

Figure 24:
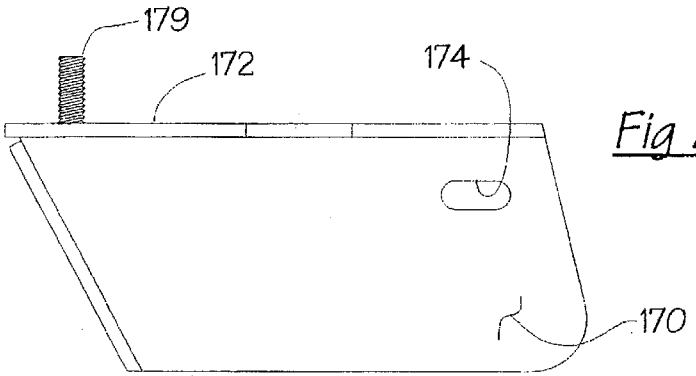
FIG. 24 is a side view of the mouse support tray mounting bracket.
Figure 22:
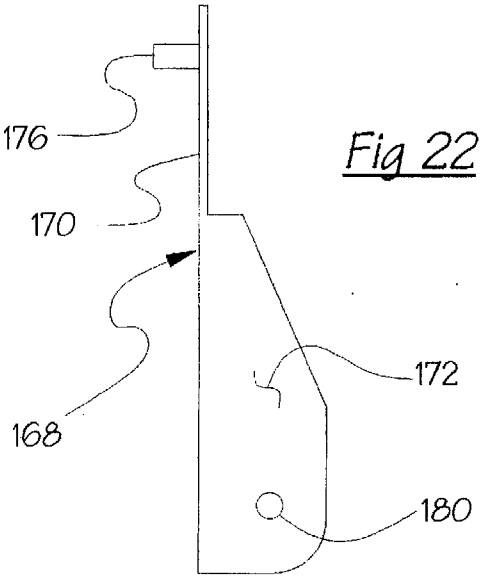
FIG. 22 is a top view of the mouse support tray mounting bracket.
Figure 23:
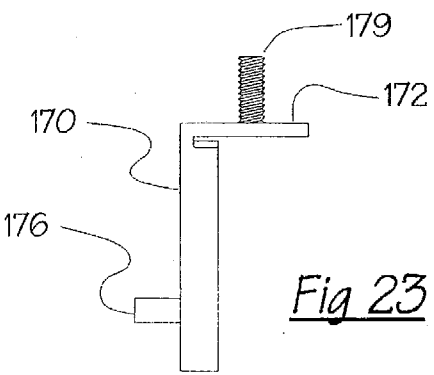
FIG. 23 is a front view of the mouse support tray mounting bracket.

Referring to FIGS. 22–24, wherein the mouse support tray support 20 may further comprise a mounting bracket 168 which is generally adapted to adjustably mount to the main housing 14 and to allow the mouse support tray 20 to be movably be adjusted thereon. The mounting bracket 168 comprises a side wall or mounting surface 170 having a slot or opening 174 and a protrusion 176. The slot 174 and protrusion 176 are adapted to be adjustably mounted to the main housing 14 by conventional means such as a bolt (not shown) and a knob 178 (FIGS. 1–3). The slot 174 allows the bolt (not shown) and the knob 178 when unengaged to be moved up or down within the slot 174. The protrusion 176 rides within the slot 30 to provide additional support. The mounting bracket 168 further comprises mounting member 179 which in the preferred embodiment is a threaded bolt securely positioned within an opening 180 provided on the mounting portion 172. The mouse tray support member 20 is adjustably positioned with respect to the mounting portion 172 by rotating the mouse tray support member 20 and then engaging a knob 182 (FIGS. 1–3) with the mounting member 178. Alternatively, the bracket member 168 could be eliminated or otherwise formed integral to the main housing 14. As such, the mouse tray support 20 could be adjustably mounted directly to the main housing 14.

In operation, the stationary bracket 12 would first be attached to the bottom surface of the desk. Thereafter the main housing 14 would be slidably engaged with the stationary bracket 12. Thereafter, the user would disengage engagement members 22 and 24 by loosening the knobs 146 and 148. Thereafter, the user would adjust the keyboard support tray 16 by simply placing his/her hands under the keyboard support tray 16 and selectively lifting the same into one of the openings 38 located on each of the side walls 26 and 28 of the main housing 14. Thereafter, the user can adjust the negative tilt angle of the keyboard support tray 16 by simply rotating the keyboard support tray upward and/or downward. To secure the position of the keyboard support tray 16, the engagement members 22 and 24 are engaged by simply tightening the knobs 146 and 148. Concurrently, the user may also adjust the position of the palm rest 18 by simply rotating the palm rest 18 at the same time that the tilt angle of the keyboard support tray 16 is being adjusted. When the engagement members 22 and 24 are engaged, both the keyboard support tray 16 and the palm rest 18 are fixed. Independent of the positioning of the keyboard support tray 16 and the palm rest 18, the vertical and horizontal position of the mouse support tray 20 may adjusted.

The foregoing description is intended primarily for purposes of illustration. This invention may be embodied in other forms or carried out in other ways without departing from the spirit or scope of the invention. Modifications and variations still falling within the spirit or the scope of the invention will be readily apparent to those of skill in the art.

What is claimed is:

1. A device adapted to mount to a desk and for use with a computer keyboard and mouse, the device comprises:

(a) a stationary bracket attached to the desk;

(b) a main housing movably engageable with said stationary bracket, said main housing having a first side wall and a second side wall;

(c) a keyboard support tray movably supported by said main housing and adapted to support the keyboard;

(d) a palm rest; and (e) a first engagement member engageable with said first sidewall and said keyboard support tray, said first engagement member also being engageable with said palm rest and being operable from a first position whereby said keyboard support tray is movable and whereby said palm rest is movable relative to said keyboard support tray to a second position whereby the position of said keyboard support tray and said palm rest are substantially fixed.

2. The device of claim 1, wherein said first engagement member comprises an arm member having a first portion rotatably connected to said first sidewall and a second portion engageable with said keyboard support tray and said palm rest.

3. The device of claim 2, wherein said first engagement member further comprises means for substantially securing and releasing said second portion of said arm member to said support tray and to said palm rest so that said first engagement member is operable from said first position whereby said keyboard support tray is movable and whereby said palm rest is movable relative to said keyboard support tray to said second position whereby the position of said keyboard support tray and said palm rest are substantially fixed.

4. The device of claim 3, wherein said securing and releasing means comprises a bolt and a knob, said bolt passing through said support tray, said arm member and said palm rest, said knob being rotatable upon said bolt to thereby fix the position of said support tray and said palm rest.

* * * * *